US007740489B2

(12) United States Patent
Trout et al.

(10) Patent No.: US 7,740,489 B2
(45) Date of Patent: Jun. 22, 2010

(54) CONNECTOR ASSEMBLY HAVING A COMPRESSIVE COUPLING MEMBER

(75) Inventors: David Allison Trout, Lancaster, PA (US); James Lee Fedder, Etters, PA (US); Jeffrey Byron McClinton, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/250,234

(22) Filed: Oct. 13, 2008

(65) Prior Publication Data

US 2010/0093193 A1 Apr. 15, 2010

(51) Int. Cl.
*H01R 12/00* (2006.01)

(52) U.S. Cl. ..... 439/75; 439/74

(58) Field of Classification Search ..... 439/74, 439/65, 75, 44–45, 47–48
See application file for complete search history.

(56) References Cited

U.S. PATENT DOCUMENTS

| | | | | |
|---|---|---|---|---|
| 4,012,093 | A * | 3/1977 | Crane | 439/67 |
| 4,012,095 | A | 3/1977 | Doucet et al. | |
| 4,057,311 | A | 11/1977 | Evans | |
| 4,085,990 | A | 4/1978 | Jayne | |
| 4,428,632 | A | 1/1984 | Rich | |
| 4,518,210 | A | 5/1985 | Morrison | |
| 4,603,928 | A | 8/1986 | Evans | |
| 4,626,056 | A | 12/1986 | Andrews, Jr. et al. | |
| 4,629,270 | A | 12/1986 | Andrews, Jr. et al. | |
| 4,731,698 | A | 3/1988 | Millot et al. | |
| 4,840,569 | A | 6/1989 | Cabourne | |
| 4,895,521 | A | 1/1990 | Grabbe | |
| 4,895,522 | A | 1/1990 | Grabbe | |
| 5,092,781 | A | 3/1992 | Casciotti et al. | |
| 5,102,342 | A | 4/1992 | Marian | |
| 5,171,154 | A | 12/1992 | Casciotti et al. | |
| 5,228,863 | A | 7/1993 | Campbell et al. | |
| 5,345,366 | A | 9/1994 | Cheng et al. | |
| 5,441,424 | A | 8/1995 | Morlion et al. | |
| 5,685,073 | A | 11/1997 | Estes et al. | |

(Continued)

FOREIGN PATENT DOCUMENTS

| | | |
|---|---|---|
| EP | 0459356 | 8/1995 |

OTHER PUBLICATIONS

European Search Report, European Application Number EP 09 17 2816, European Filing Date Oct. 12, 2009.

*Primary Examiner*—Michael C Zarroli

(57) ABSTRACT

A connector assembly includes a housing, a contact and a compressive coupling member. The housing has a mating interface and a mounting interface on opposing sides of the housing. The mounting interface is configured to engage a first substrate when the housing is mounted to the first substrate. The mating interface is configured to mate with a mating connector that is mounted to a second substrate. The housing is configured to engage and interconnect the substrates in a parallel arrangement. The contact extends between and protrudes from the interfaces of the housing and is configured to provide an electrical connection between the substrates. The compressive coupling member is configured to extend through the substrates and the housing in a direction transverse to the interfaces. The coupling member is configured to apply a compressive force to the housing to secure the housing with the mating connector to electrically and mechanically interconnect the substrates.

20 Claims, 6 Drawing Sheets

U.S. PATENT DOCUMENTS 5,772,451 A 6/1998 Dozier, II et al.
RE36,065 E 1/1999 Andrews et al.
5,904,581 A 5/1999 Pope et al.
6,027,345 A 2/2000 McHugh et al.
6,062,872 A 5/2000 Strange et al.
6,077,090 A 6/2000 Campbell et al.
6,083,047 A 7/2000 Paagman
6,116,965 A 9/2000 Arnett et al.
6,135,781 A 10/2000 Pope et al.
6,231,391 B1 5/2001 Ramey et al.
6,310,286 B1 10/2001 Troxel et al.
6,356,448 B1 3/2002 DiBene, II et al.
6,394,822 B1 5/2002 McNamara
6,411,517 B1 6/2002 Babin
6,443,745 B1 9/2002 Ellis et al.
6,461,202 B2 10/2002 Kline
6,537,087 B2 3/2003 McNamara et al.
6,551,140 B2 4/2003 Billman et al.
6,623,280 B2 9/2003 Oldenburg et al.
6,672,878 B2 1/2004 Dean
6,682,368 B2 1/2004 Murr et al.
6,695,646 B1 2/2004 Grabbe
6,699,048 B2 3/2004 Johnson et al.
6,705,895 B2 3/2004 Hasircoglu
6,712,620 B1 3/2004 Li et al.
6,739,910 B1 5/2004 Wu
6,743,049 B2 6/2004 Perugini et al.
6,743,057 B2 6/2004 Davis et al.
6,809,255 B1 10/2004 Chun
6,866,521 B1 3/2005 Harper, Jr.
6,875,056 B1 4/2005 Bianchini et al.
6,899,550 B2 5/2005 Perugini et al.
6,902,416 B2 6/2005 Feldman
6,917,525 B2 7/2005 Mok et al.
6,918,776 B2 7/2005 Spink
6,932,618 B1 8/2005 Nelson
6,932,655 B2 8/2005 Hatterscheid et al.
6,945,788 B2 9/2005 Trout et al.
6,951,482 B1 10/2005 Miller et al.
7,018,239 B2 3/2006 Zaderej et al.
7,021,945 B2 4/2006 Perugini et al.
7,044,746 B2 5/2006 Copper et al.
7,086,872 B2 8/2006 Myer et al.
7,086,913 B2 8/2006 Myer et al.
7,097,470 B2 8/2006 Harper
7,114,961 B2 10/2006 Williams
7,207,807 B2 4/2007 Fogg
7,244,125 B2 7/2007 Brown et al.
7,262,672 B2 8/2007 Lee et al.
7,297,015 B1 11/2007 Desrosiers et al.
7,309,239 B2 12/2007 Shuey et al.
7,374,441 B2 5/2008 Rubenstein
7,390,194 B1 6/2008 Crippen et al.
7,419,400 B1 9/2008 Taylor et al.
7,425,134 B1 9/2008 Taylor
7,429,176 B2 9/2008 Johnescu et al.
7,438,582 B2 10/2008 Taylor
7,465,195 B1 12/2008 Kerrigan et al.
7,470,149 B2 12/2008 Kazama et al.
2001/0049207 A1 12/2001 Sakata et al.
2002/0151218 A1 10/2002 Figueroa et al.
2003/0277439 2/2003 Johnescu et al.
2003/0064614 A1 4/2003 Tanaka et al.
2003/0082954 A1 5/2003 Espenshade et al.
2003/0162442 A1 8/2003 Panella
2004/0161954 A1 8/2004 Johnescu et al.
2004/0166704 A1 8/2004 Perugini et al.
2004/0174223 A1 9/2004 Achyut
2006/0019517 A1 1/2006 Raistrick et al.
2007/0097662 A1 5/2007 Dean
2007/0197095 A1 8/2007 Feldman et al.
2008/0032524 A1 2/2008 Lemke et al.
2008/0188098 A1 8/2008 Boesch et al.
2008/0214059 A1 9/2008 Rothermel et al.
2008/0227314 A1 9/2008 Taylor
2008/0233806 A1 9/2008 Rothermel et al.

* cited by examiner

CONNECTOR ASSEMBLY HAVING A COMPRESSIVE COUPLING MEMBER

BACKGROUND OF THE INVENTION

The invention relates generally to electrical connectors and, more particularly, to a connector assembly that mechanically and electrically connects substrates.

Known mezzanine connectors mechanically and electrically connect circuit boards. A header assembly is mounted to one circuit board and a mating connector is mounted to another circuit board. The header assembly and the mating connector mate with one another to mechanically and electrically interconnect the circuit boards. The circuit boards are separated from one another by a stack height when interconnected by the header assembly and the mating connector. Contacts in the header assembly and the mating connector mate with the circuit boards and provide the electrical connections between the circuit boards. In order to secure the header assembly and the mating connector together, the header assembly and the mating connector are manually pushed toward one another. The manual pushing on the header assembly and the mating connector can be an unreliable manner for securing the header assembly and the mating connector together. The manual pushing on the header assembly and the mating connector may be insufficient to mechanically and electrically connect the header assembly and the mating connector. The header assembly and the mating connector may require a significant amount of mating force to mate the header assembly and the mating connector. Manually applying the mating force on the circuit boards to which the header assembly and the mating connector are mounted may overly stress the circuit boards or prohibit contacts in the header assembly or mating connector from reliable electrical engagement with the circuit boards. Additionally, the circuit boards may plastically deform or break due to the manual application of the mating force.

Thus, a need exists for a more reliable and controllable manner for mechanically and electrically mating a header assembly and a mating connector to mechanically and electrically interconnect circuit boards with one another.

BRIEF DESCRIPTION OF THE INVENTION

In one embodiment, a connector assembly includes a housing, a contact and a compressive coupling member. The housing has a mating interface and a mounting interface on opposing sides of the housing. The mounting interface is configured to engage a first substrate when the housing is mounted to the first substrate. The mating interface is configured to mate with a mating connector that is mounted to a second substrate. The housing is configured to engage and interconnect the substrates in a parallel arrangement. The contact extends between and protrudes from the interfaces of the housing and is configured to provide an electrical connection between the substrates. The compressive coupling member is configured to extend through the substrates and the housing in a direction transverse to the interfaces. The coupling member is configured to apply a compressive force to the housing to secure the housing with the mating connector to electrically and mechanically interconnect the substrates.

In another embodiment, a connector assembly includes a mating connector, a header assembly and a compressive coupling member. The mating connector is configured to be mounted to a first substrate. The header assembly is configured to be mounted to a second substrate and to mate with the mating connector to mechanically and electrically interconnect the first and second substrates in a parallel arrangement. The header assembly includes a housing and a contact. The housing has interfaces on opposing sides of the housing. One of the interfaces engages the mating connector and the other one of the interfaces engages the second substrate to mechanically interconnect the substrates. The contact extends between and protrudes from the interfaces of the housing. The contact is configured to engage the mating connector and the second substrate to provide an electrical connection between the substrates. The compressive coupling member is configured to extend through the substrates, the housing and the mating connector in a direction transverse to the interfaces. The coupling member is configured to apply a compressive force to the header assembly and the mating connector to secure the header assembly and the mating connector together.

DETAILED DESCRIPTION OF THE INVENTION

Figure 1:
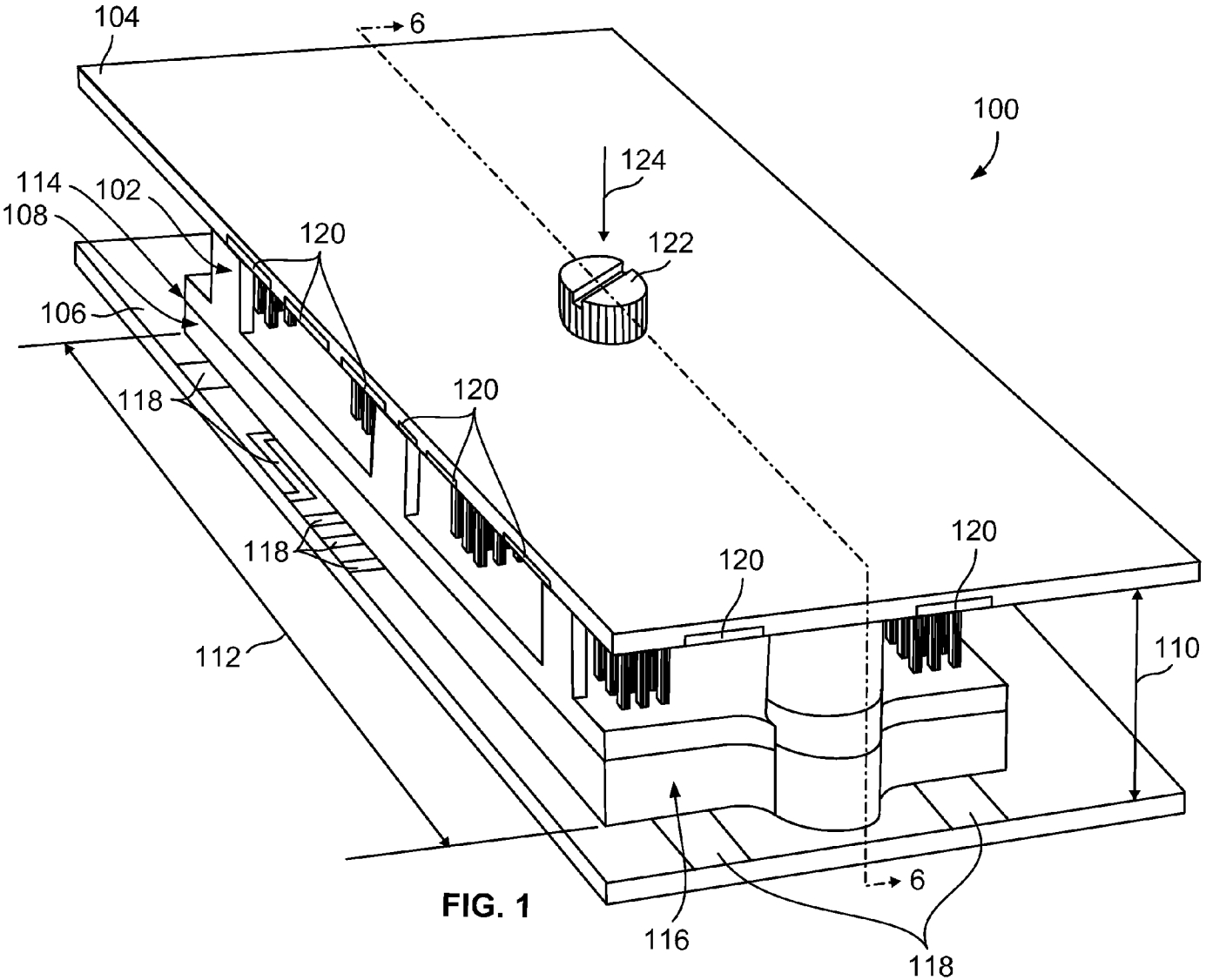
FIG. 1 is a bottom perspective view of a mezzanine connector assembly according to one embodiment.

FIG. 1 is a bottom perspective view of a connector assembly 100 according to one embodiment. The connector assembly 100 includes a mezzanine connector assembly 102 that mechanically and electrically connects a plurality of substrates 104, 106 in a parallel arrangement. As shown in FIG. 1, the substrates 104, 106 are interconnected by the mezzanine connector assembly 102 so that the substrates 104, 106 are substantially parallel to one another. The substrates 104, 106 may include circuit boards. For example, a first substrate 104 may be a daughter board and a second substrate 106 may be a motherboard. While the substrates 104, 106 may be embodied in devices other than circuit boards in accordance with various embodiments described herein, the first substrate 104 is referred to as the daughter board 104 and the second substrate 106 is referred to as the motherboard 106. The motherboard 106 includes conductive pathways 118 and the daughter board 104 includes conductive pathways 120. The conductive pathways 118, 120 communicate data signals and/or electric power between the motherboard 106 and the daughter board 104 and one or more electric components (not shown) that are electrically connected to the motherboard 106 and/or the daughter board 104. The conductive pathways 118, 120 may be embodied in electric traces in a circuit board, although other conductive pathways, contacts, and the like, may be the conductive pathways 118, 120.

A mating connector 108 is mounted to the motherboard 106 in the illustrated embodiment. The header assembly 102 is mounted to the lower substrate 104 and mates with the mating connector 108 to electrically and mechanically couple the motherboard 106 and the daughter board 104. In another example, the mating connector 108 is mounted to the daughter board 104. Alternatively, the mezzanine connector assembly 102 may directly mount to each of the motherboard 106 and the daughter board 104 to electrically and mechanically couple the motherboard 106 and the daughter board 104. The motherboard 106 and the daughter board 104 may include electrical components (not shown) to enable the connector assembly 100 to perform certain functions. For purposes of illustration only, the connector assembly 100 may be a blade for use in a blade server. It is to be understood, however, that other applications of the inventive concepts herein are also contemplated.

The connector assembly 100 separates the motherboard 106 and the daughter board 104 by a stack height 110. The stack height 110 may be approximately constant over an outer length 112 of the connector assembly 100. The outer length 112 extends between opposing ends 114, 116 of the connector assembly 100. Alternatively, the stack height 110 may differ or change along the outer length 112 of the connector assembly 100. For example, the connector assembly 100 may be shaped such that the motherboard 106 and the daughter board 104 are disposed transverse to one another. The stack height 110 may be varied by connecting the motherboard 106 and the daughter board 104 using different header assemblies 102 and/or the mating connectors 108. The sizes of the header assemblies 102 and/or the mating connectors 108 may vary so that the stack height 110 may be selected by an operator. For example, an operator may select one header assembly 102 and/or mating connector 108 to separate the motherboard 106 and the daughter board 104 by a desired stack height 110.

A compressive coupling member 122 is disposed through at least one of the motherboard 106 and the daughter board 104 and extends through the connector assembly 100. As described below, the coupling member 122 may be manually manipulated to apply or reduce a compressive force 124 on the header assembly 102 and the mating connector 108. The compressive force 124 is applied to assembly 102 and the mating connector 108 in a direction transverse to the motherboard 106 and/or the daughter board 104. For example, the compressive force 124 may be applied to the assembly 102 and the mating connector 108 in a direction perpendicular to the motherboard 106 and/or the daughter board 104. The coupling member 122 applies the compressive force 124 to secure the header assembly 102 and mating connector 108 together in a mating relationship. In one embodiment, the coupling member 122 applies the compressive force 124 to mate the assembly 102 and the mating connector 108 without requiring the motherboard 106 and the daughter board 104 to bend, or bow, by a distance that damages the motherboard 106 and/or the daughter board 104.

Figure 2:
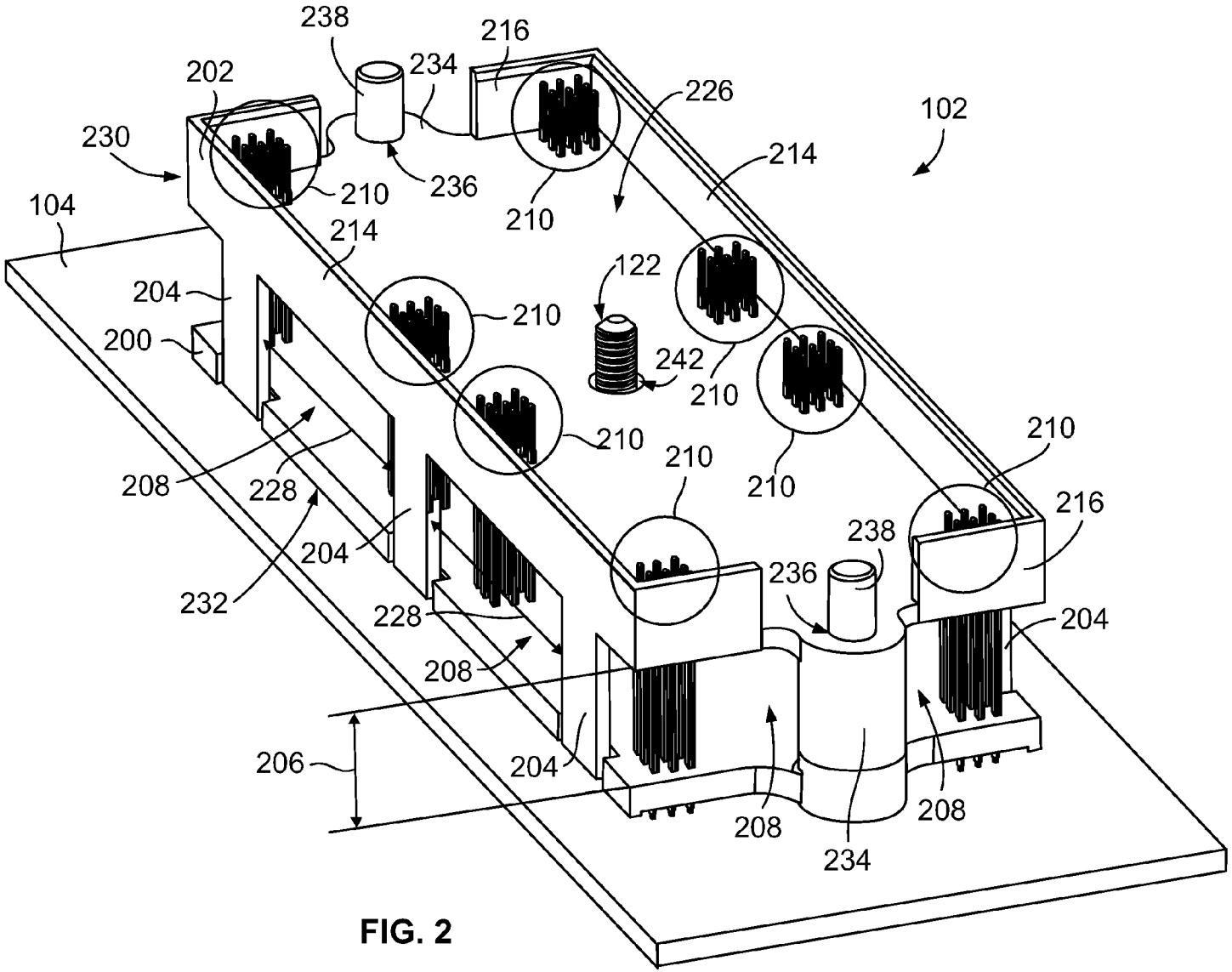
FIG. 2 is a bottom perspective view of a header assembly shown in FIG. 1.

FIG. 2 is a bottom perspective view of the header assembly 102. The header assembly 102 includes a housing 230 composed of a mounting body 200 and a mating body 202 interconnected by spacer bodies 204. One or more of the mounting and mating bodies 200, 202 may be a unitary body. For example, each of the mounting and mating bodies 200, 202 may be homogeneously formed of a dielectric material, such as a plastic material. The spacer bodies 204 are shown in FIG. 2 as columns that couple the mating and mounting bodies 202, 200. Alternatively, the spacer bodies 204 may be embodied in a different shape that couples the mating and mounting bodies 202, 200. For example, the spacer bodies 204 may be embodied in the spacer body described in co-pending U.S. patent application Ser. No. 12/250,299 entitled "Mezzanine Connector Assembly With Variable Stack Heights Having Power And Signal Contacts," filed Oct. 13, 2008, and having an (referred to herein as the "'299 application"). The entire disclosure of the '299 application is incorporated by reference herein in its entirety.

The spacer bodies 204 separate the mating and mounting bodies 202, 200 by a separation gap 206. The spacer bodies 204 extend between the mating and mounting bodies 202, 200 in a direction transverse to both the mating and mounting bodies 202, 200. For example, the spacer bodies 204 may be perpendicular to the mating and mounting bodies 202, 200. The separation of the mating and mounting bodies 202, 200 by the separation gap 206 and the separation of the spacer bodies 204 by the inside dimension 228 provides openings 208 into the interior of the header assembly 102 between the mating and mounting bodies 202, 200.

The openings 208 permit air to flow through the header assembly 102. Permitting air to flow through the header assembly 102 provides an additional channel of air flow between the daughter board 104 and the motherboard 106. Additional components (not shown) on the daughter board 104 and the motherboard 106 can produce thermal energy, or heat. The air flow between the daughter board 104 and the motherboard 106 may reduce this heat by cooling the components. The openings 208 though the header assembly 102 permits the air to flow through the header assembly 102 and prevents the header assembly 102 from overly restricting the air flow between the daughter board 104 and the motherboard 106.

Thermal energy, or heat, may be generated inside the header assembly 102 as the header assembly 102 communicates electric power between the motherboard 106 (shown in FIG. 1) and the daughter board 104. The communication of electric power at sufficiently high current through the header assembly 102 can generate thermal energy within the header assembly 102. As the current at which the electric power is communicated increases, the heat that is generated may increase. In order to dissipate this heat, the openings 208 permit access to the interior of the header assembly 102. For example, the openings 208 permit air to flow between the mounting and mating bodies 200, 202 through the header assembly 102. One or more fans (not shown) or other components may generate the air flow through the header assembly 102. Separating the mounting and mating bodies 200, 202 by the separation gap 206 and permitting air to flow between the mounting and mating bodies 200, 202 through the openings 208 may reduce the heat within the header assembly 102.

The mating body 202 comprises a mating interface 226 at least partially bounded by plurality of sidewalls 214 and a plurality of end walls 216. The mating interface 226 engages the mating connector 108 (shown in FIG. 1) when the header assembly 102 and the mating connector 108 mate with one another to electrically interconnect the daughter board 104 and the motherboard 106 (shown in FIG. 1). Alternatively, the mating interface 226 may directly engage the motherboard 106 without engaging the mating connector 108. The sidewalls and end walls 214, 216 protrude from the header assembly header assembly 102 in a direction transverse to the mating interface 226. For example, the sidewalls and end walls 214, 216 may perpendicularly protrude from the mating interface 226. The sidewalls 214 and end walls 216 form a shroud in which at least a portion of the mating connector 108 is received when the header assembly 102 and the mating connector 108 mate with one another. The mating interface 226 includes an opening 242 through which the compressive coupling member 122 extends.

A mounting interface 232 is disposed on the mounting body 200 and engages the daughter board 104 when the header assembly 102 is mounted to the daughter board 104. The mounting and mating interfaces 232, 226 are parallel with respect to one another in the illustrated embodiment. The mounting and mating interfaces 232, 226 may be parallel with the daughter board 104 and the motherboard 106.

The header assembly 102 includes alignment columns 234 that extend transverse to the mating and mounting interfaces 226, 232 of the mating and mounting bodies 202, 200. In the illustrated embodiment, the alignment columns 234 extend perpendicular to the mating and mounting interfaces 226, 232. The alignment columns 234 include channels 236 in which an alignment post 238 is received. The alignment posts 238 extend through the channels 236 and into post cavities 404 (shown in FIG. 4) in the mating connector 108 (shown in FIG. 1) to align the header assembly 102 and the mating connector 108 with respect to one another. Alternatively, the header assembly 102 and/or the mating connector 108 may include one or more polarization features to align the header assembly 102 and the mating connector 108 with respect to one another. For example, the header assembly 102 and the mating connector 108 may include polarization features similar to the polarization features and slots described in the '299 application. In one embodiment, the header assembly 102 includes one or more latches to mechanically secure the mating connector 108 and header assembly 102 together. For example, the header assembly 102 may include latches similar to the latches described in the '299 application.

The header assembly 102 includes a plurality of contacts 210. The header assembly 102 may include a different number and/or arrangement of contacts 210 than those shown in FIG. 2. The contacts 210 mate with the mating connector 108 (shown in FIG. 1) and the daughter board 104 to provide electronic communication paths the between the motherboard 106 (shown in FIG. 1) and the daughter board 104. The contacts 210 may generate some thermal energy or heat as electric current or signals are communicated using the contacts 210. The contacts 210 protrude from the mating interface 226 to mate with the mating connector 108 (shown in FIG. 1). The contacts 210 protrude from the mounting interface 232 to mate with the daughter board 104. At least a portion of the contacts 210 is exposed in the header assembly 102 between the mating and mounting bodies 202, 200. For example, a portion of the contacts 210 may be exposed to the atmosphere or air within the header assembly 102 and not encompassed or held by another component of the header assembly 102 within the separation gap 206 between the mating and mounting bodies 202, 200. Exposing portions of the contacts 210 within the separation gap 206 of the header assembly 102 may more easily permit the thermal energy or heat generated by the contacts 210 to be dissipated. For example, the air flow through the header assembly 102 may dissipate the heat generated by the contacts 210 so that the contacts 210 may operate at increased data rates or communicate greater electric current when compared to known mezzanine connectors.

Figure 3:
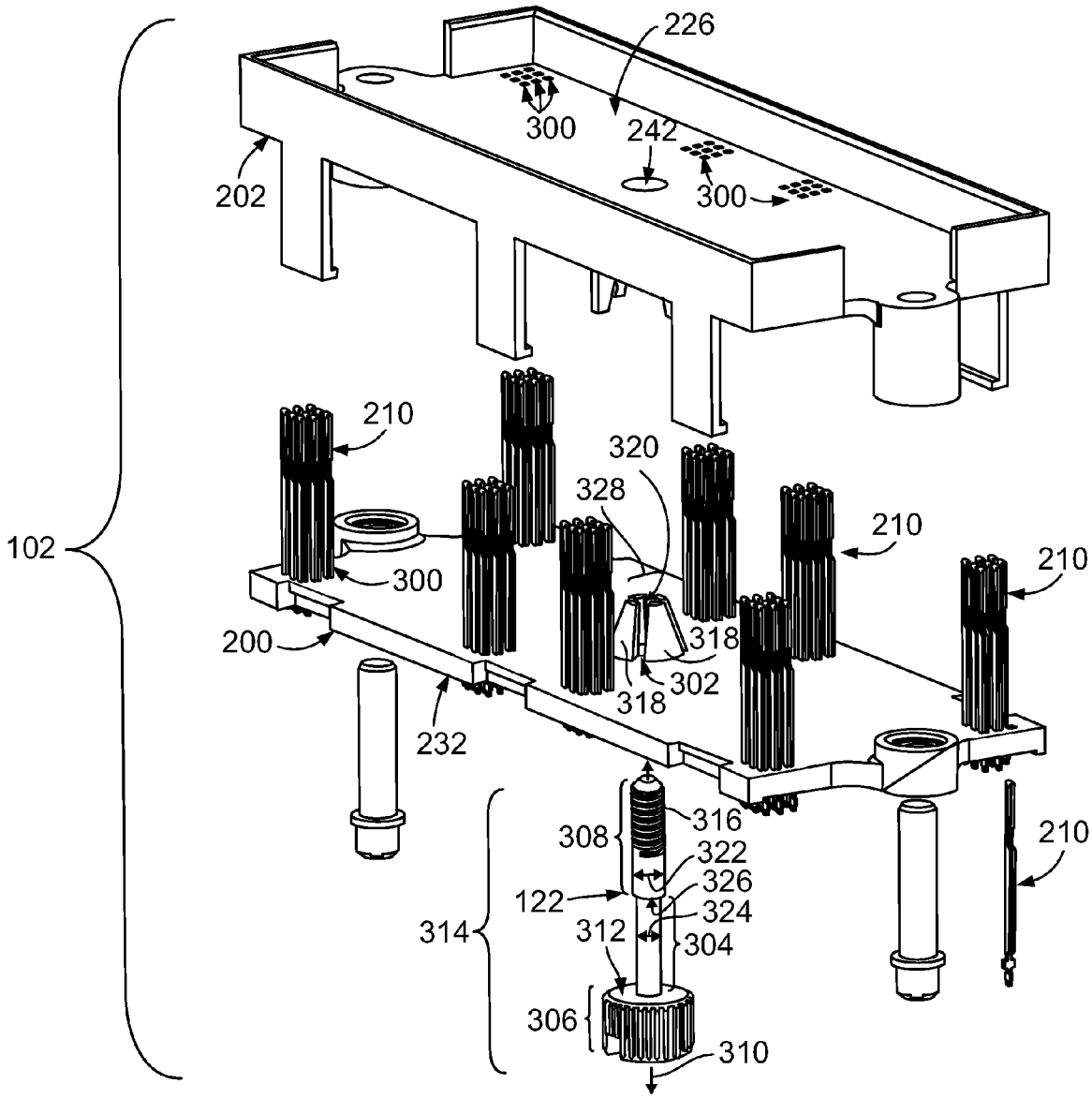
FIG. 3 is an exploded view of the header assembly shown in FIG. 1.

FIG. 3 is an exploded view of the header assembly 102. The mounting and mating bodies 200, 202 of the header assembly 102 include openings 300 through which the contacts 210 are respectively loaded. The contacts 210 are held by the header assembly 102 such that the contacts 210 are arranged transverse to the mating and mounting interfaces 226, 232. For example, the contacts 210 may be substantially perpendicular to the mating and mounting bodies 202, 200. In another example, the contacts 210 may be substantially perpendicular to the motherboard 106 (shown in FIG. 1) and the mother board 104 such that the motherboard 106 and the mother board 104 are parallel with respect to one another when coupled with the header assembly 102.

As described above, the mating body 202 includes an opening 242 through which the coupling member 122 extends. The mounting body 200 includes an opening 302 through which the coupling member 122 also extends. The opening 242 in the mating body 202 and the opening 302 in the mounting body 200 are aligned with respect to one another. For example, an elongated body such as the coupling member 122 may extend through both of the openings 242, 302 at the same time. The mounting body 200 includes a plurality of fingers 318 that extend from the mounting body 200 toward the mating body 202. For example, the fingers 318 may extend from the mounting body 200 to finger ends 328. The fingers 318 may be homogeneously formed as a unitary body with the mounting body 200. The fingers 318 are tapered inward in the illustrated embodiment such that an opening 320 between the fingers ends 328 is smaller than the opening 302 in the mounting body 200.

Figure 5:
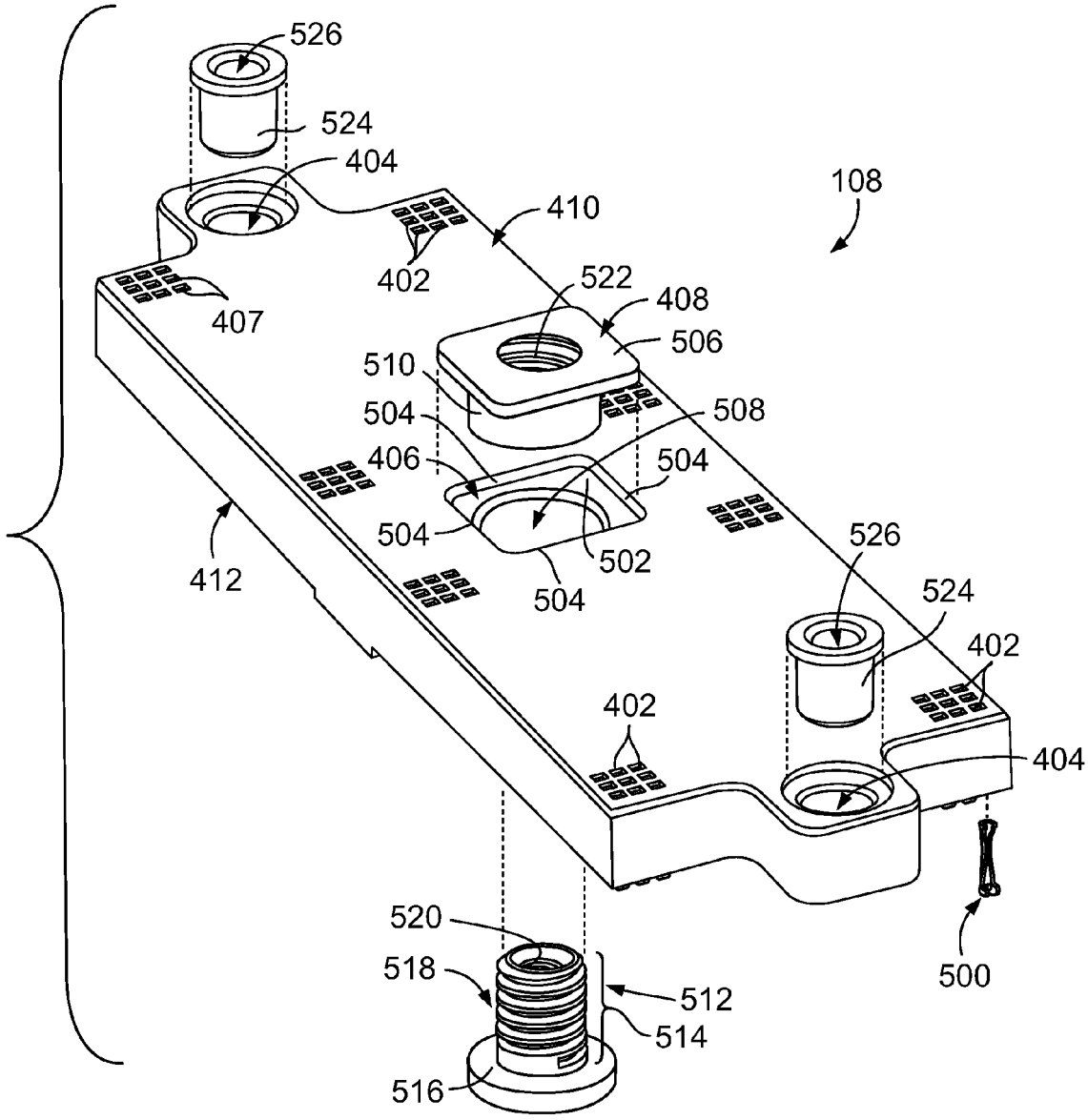
FIG. 5 is an exploded view of the mating connector shown in FIG. 1.

In the illustrated embodiment, the coupling member 122 includes an elongated portion 314 and a coupling member nut 512 (shown in FIG. 5). The coupling member 122 may be embodied in a device such as a jackscrew and a matching nut, but other embodiments may be used. For example, the coupling member 122 may be embodied in a cam lock or lever. As described below, the elongated portion 314 is received by the coupling member nut 512 to apply the compressive force 124 to the header assembly 102 and the mating connector 108 (shown in FIG. 1). The elongated portion 314 includes an elongated body 304 that extends between a head portion 306 and a tail portion 308. A shoulder 326 may be disposed between the elongated and tail portions 314, 308. The head and tail portions 306, 308 extend from the elongated body 304 in opposing directions along a longitudinal axis 310 of the coupling member 122. The tail portion 308 includes a threaded surface 316. The head portion 306 includes a flange 312 that extends radially outward from the elongated body 304. The elongated body 304 and tail portion 308 have different outer diameters 322, 324 in the illustrated embodiment. For example, the elongated body 304 may have a smaller diameter 324 than the diameter 322 of the tail portion 308. In one embodiment, the diameter 322 of the tail portion 308 is larger than the opening 320 defined by the finger ends 328 of the mounting body 200.

As described below, the elongated body 314 of the coupling member 122 is loaded through the header assembly 102 through the openings 242, 302. In one embodiment, the elongated body 314 is loaded into the header assembly 102 by inserting the tail portion 308 of the elongated body 314 into the opening 302 in the mounting body 202 through the mounting interface 232. The fingers 318 are biased away from one another as the tail portion 308 is loaded into the header assembly 102. The fingers 318 return toward the original position of the fingers 318 after the tail portion 308 is inserted into the header assembly 102 past the finger ends 328. The fingers 318 may then prevent the elongated body 314 from being removed from the header assembly 102 through the opening 302 in the mounting body 202. For example, the finger ends 328 may engage the shoulder 326 in the elongated body 314 of the coupling member 122 to prevent removal of the elongated body 314 through the opening 302.

Figure 4:
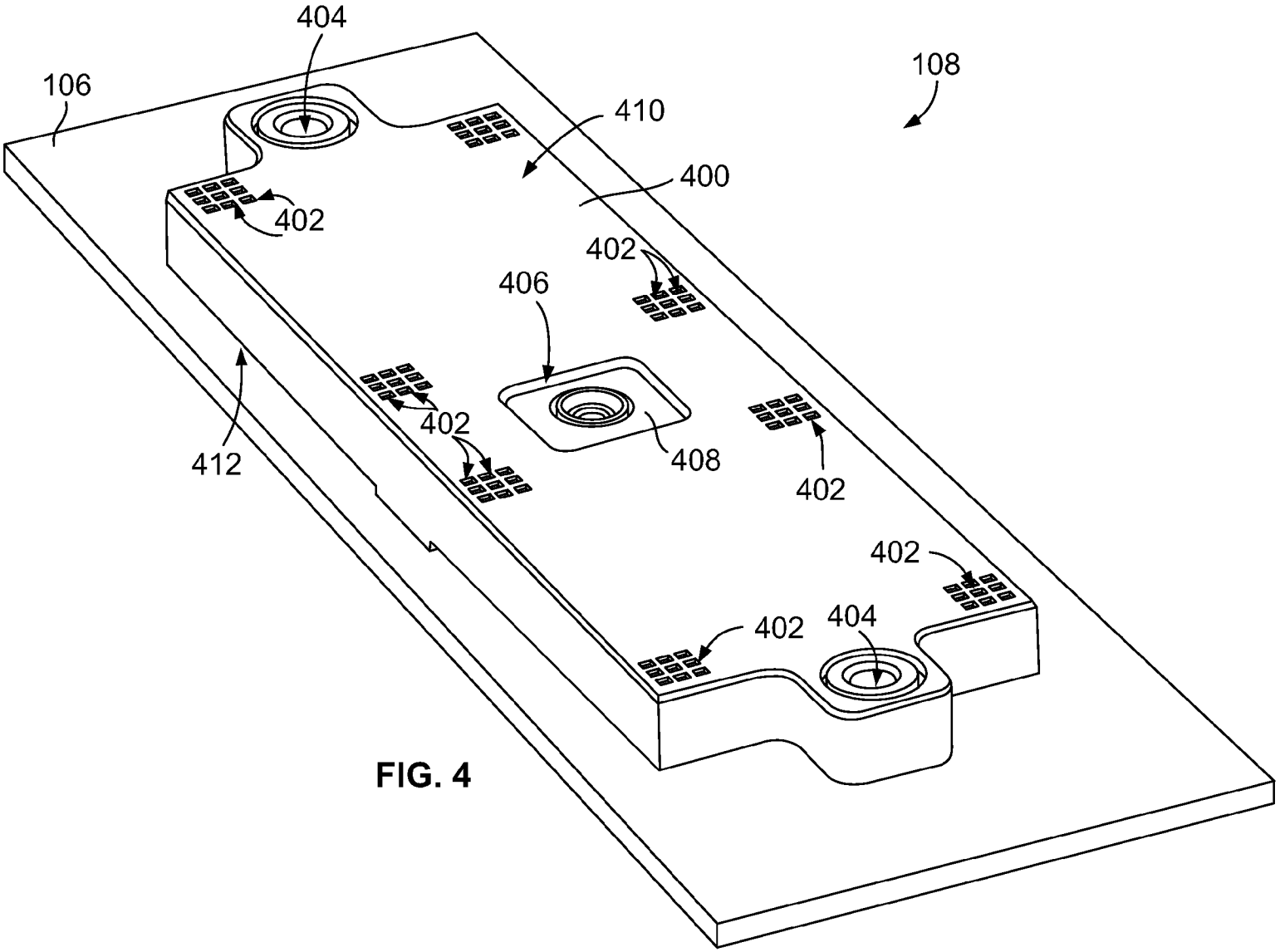
FIG. 4 is a perspective view of the mating connector shown in FIG. 1 mounted to a daughter board shown in FIG. 1.

FIG. 4 is a perspective view of the mating connector 108 mounted to the motherboard 106. The mating connector 108 includes a housing 400 that extends between a mating interface 410 and a mounting interface 412. The mating interface 410 engages the mating interface 226 (shown in FIG. 2) of the header assembly 102 (shown in FIG. 1) when the header assembly 102 and the mating connector 108 mate with one another. The mounting interface 412 engages the motherboard 106 when the mating connector 108 is mounted to the motherboard 106.

The housing 400 includes cavities 402 that extend from the mating interface 410 toward the mounting interface 412. The cavities 402 receive the contacts 210 (shown in FIG. 2) of the header assembly 102 (shown in FIG. 1) when the header assembly 102 and the mating connector 108 mate with one another. The mating connector 108 may include additional cavities 402 and/or a different arrangement of the cavities 402 than the cavities 402 shown in the illustrated embodiment. The housing 400 includes post cavities 404 in which the alignment posts 238 (shown in FIG. 2) are received. As described above, the alignment posts 238 extend through the channels 236 (shown in FIG. 2) in the header assembly 102 and into the alignment cavities 404 to align the header assembly 102 and the mating connector 108 in one embodiment. The housing 400 includes a coupling member cavity 406 into which a retaining element 408 is received. The retaining element 408 includes an inner threaded surface 410. In one embodiment, the inner threaded surface 410 engages the coupling member nut 512 (shown in FIG. 5) to secure the coupling member nut 512 to the housing 400. Alternatively, the inner threaded surface 410 engages the tail portion 308 (shown in FIG. 3) of the coupling member 122 to secure the coupling member 122 to the housing 400. For example, the inner threaded surface 410 may engage the tail portion 308 when the header assembly 102 and the mating connector 108 mate with one another and the coupling member 122 is loaded through the header assembly 102 and received in the retaining element 408. In another embodiment, the housing 400 includes the inner threaded surface 410 and the retaining element 408 is not included in the mating connector 108. For example, the housing 400 may include the inner threaded surface 410 as a part of the unitary body of the housing 400. The inner threaded surface 410 may then engage the coupling member nut 512 or the tail portion 308 of the coupling member 112, as described above.

FIG. 5 is an exploded view of the mating connector 108. Mating contacts 500 are loaded into the cavities 402 from the mounting interface 412 of the mating connector 108. While one example mating contact 500 is shown in FIG. 5, a different mating contact may be used in place of the mating contact 500. In the illustrated embodiment, the mating contacts 500 receive the contacts 210 (shown in FIG. 2) of the header assembly 102 (shown in FIG. 1) to electrically connect the header assembly 102 and the mating connector 108. Alternatively, the contacts 210 in the header assembly 102 may receive the mating contacts 500 to when the header assembly 102 and the mating connector 108 mate with one another.

In the illustrated embodiment, the coupling member cavity 406 includes a ledge 502 that extends radially inward from side edges 504 of the cavity 406. An opening 508 through the housing 400 is disposed through the coupling member cavity 406. For example, the opening 508 provides access through the housing 400 between the mounting and mating interfaces 412, 410. The retaining element 408 includes a flange 506 and a tubular body 510. The flange 506 extends radially outward from the tubular body 510. The tubular body 510 extends from the flange 506 in a transverse direction. For example, the tubular body 510 may extend from the flange 506 in a perpendicular direction. The tubular body 510 includes an inside threaded surface 522 in the illustrated embodiment. The retaining element 408 is loaded into the cavity 406 through the mating interface 410 of the mating connector 108. The tubular body 510 is loaded into the opening 508. The flange 506 engages the ledge 502 when the retaining element 408 is loaded into the cavity 406. The flange 506 is approximately parallel with the mating interface 410 when the retaining element 408 is loaded into the cavity 406. The engagement between the flange 506 and the ledge 502 prevents the retaining element 408 from being removed from the mating connector 108 through the mounting interface 412 of the mating connector 108.

The coupling member nut 512 includes a tubular body 514 extending from a nut flange 516. The nut flange 516 is approximately planar and is disposed transverse to the tubular body 514. For example, the tubular body 514 may extend in a perpendicular direction from the nut flange 516. The nut flange 516 is disposed opposite of the flange 312 (shown in FIG. 3). The tubular body 514 includes an outer threaded surface 518 and an inner threaded surface 520 on opposing outside and inside surfaces of the body 514. During assembly of the connector assembly 100, the mating connector 108 is mounted to the motherboard 106 (shown in FIG. 1). The coupling member nut 512 is loaded into the opening 508 in the coupling member cavity 406 of the housing 410. In one embodiment, the coupling member nut 512 is loaded into the opening 508 in the coupling member cavity 406 through a hole 602 (shown in FIG. 6) in the motherboard 106. The nut flange 516 engages the motherboard 106 when the coupling member nut 512 is loaded into the opening 508 in the coupling member cavity 406. The outer threaded surface 518 of the coupling member nut 512 engages the inside threaded surface 522 of the retaining element 408 when the coupling member nut 512 is loaded into the opening 508. The engagement between the nut flange 516 of the coupling member nut 512 and the motherboard 106 and the engagement between the outer threaded surface 518 of the coupling member nut 512 and the inside threaded surface 522 of the retaining element 408 secures the mating connector 108 to the motherboard 106. For example, the engagement between the coupling member nut 512 and the retaining element 408 applies a compressive force 600 (shown in FIG. 6) between the motherboard 106 and the housing 410 of the mating connector 108. This compressive force 600 secures the mating connector 108 to the motherboard 106.

The mating connector 108 includes alignment post bushings 524 disposed in the post cavities 404. The alignment post bushings 524 receive the alignment posts 238 (shown in FIG. 2) when the mating connector 108 mates with the header assembly 102 (shown in FIG. 1). For example, the alignment post bushings 524 may include through holes 526 that receive the alignment posts 238. The alignment post bushings 524 may dampen vibrations in the connector assembly 100 (shown in FIG. 1) by reducing movement between the alignment posts 238 and both of the mating connector 108 and the header assembly 102.

Figure 6:
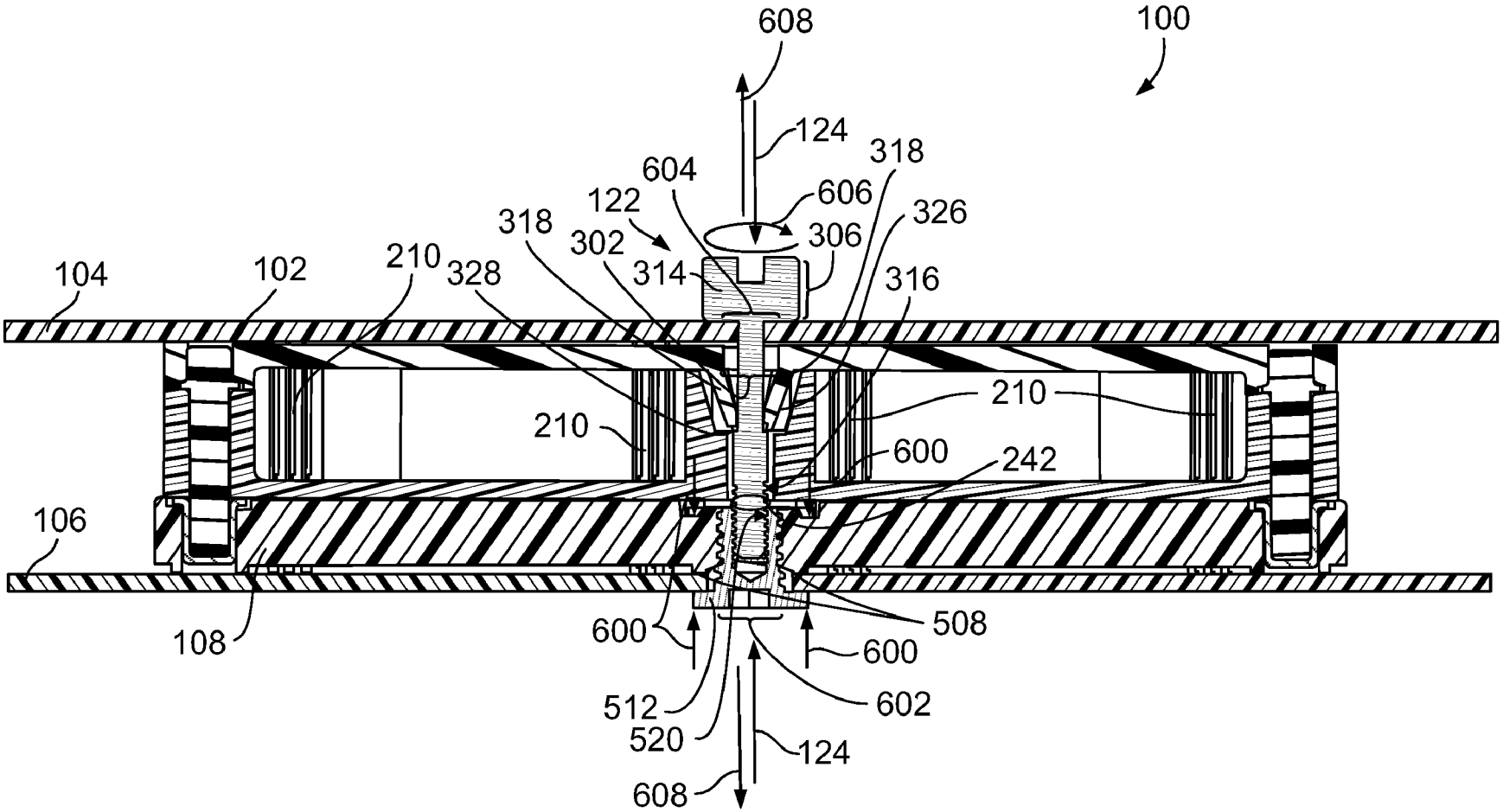
FIG. 6 is a cross-sectional view of the connector assembly shown in FIG. 1 taken along line 6-6 also shown in FIG. 1.

FIG. 6 is a cross-sectional view of the connector assembly 100 taken along line 6-6 shown in FIG. 1. As described above, the coupling member nut 512 engages the retaining element 408 through the motherboard 106. The coupling member nut 512 is at least partially loaded through the hole 602 in the motherboard 106. The illustration of the compressive force 600 shown in FIG. 6 is provided merely as an example. The location and/or distribution of the compressive force 600 may vary from the compressive force 600 shown in FIG. 6. The compressive force 600 applied to the mating connector 108 by the retaining element 408 and, the compressive force 600 applied to the motherboard 106 by the coupling member nut 512 are approximately the same in one embodiment. Alternatively, the compressive forces 600 applied to the mating connector 108 and the motherboard 106 may differ from one another.

The coupling member 122 extends through the motherboard 106, the daughter board 104, the header assembly 702 and the mating connector 108 and is received in the coupling member nut 512. In the illustrated embodiment, the coupling member 122 is loaded through a hole 604 in the daughter board 104, the openings 242, 302 in the header assembly 102, the opening 508 in the mating connector 108 and the hole 602 in the motherboard 106. The holes 602, 604 and the openings 242, 302, 508 are aligned with respect to one another to permit the coupling member 122 to extend through the holes 602, 604 and the openings 242, 302, 508 in a direction transverse to the daughter board 104 and the motherboard 106. For example, the holes 602, 604 and the openings 242, 302, 508 may be aligned with one another in a direction perpendicular to the daughter board 104 and the motherboard 106 to permit the coupling member 122 to extend through the holes 602, 604 and the openings 242, 302, 508.

As described above, the coupling member 122 includes the elongated portion 314 and the coupling member nut 512. The head portion 306 of the elongated portion 314 engages the daughter board 104 and the coupling member nut 512 engages the motherboard 106. The threaded surface 316 of elongated portion 314 is received in the inner threaded surface 520 of the coupling member nut 512. The head portion 306 may be rotated to move the head portion 306 relative to the coupling member nut 512. For example, the engagement between the threaded surfaces 316, 520 permits the head portion 306 to be manually manipulated to move the head portion 306 relative to the coupling member nut 512. Rotating the head portion 306 in a clockwise direction 606 rotates the elongated portion 314 of the coupling member 122 in the clockwise direction 606. The coupling member nut 512 remains approximately stationary as the elongated portion 314 is rotated in the clockwise direction 606. The engagement between the threaded surfaces 316, 520 causes the elongated portion 314 and coupling member nut 512 to move toward one another when the elongated portion 314 is rotated in the clockwise direction 606. Alternatively, the threaded surfaces 316, 520 may be arranged such that rotation of the elongated portion 314 in a counter-clockwise direction (opposite that of the clockwise direction 606) causes the elongated portion 314 and coupling member nut 512 to move toward one another.

The head portion 306 engages the daughter board 104 and the coupling member nut 512 engages the motherboard 106 as the elongated portion 314 and the coupling member nut 512 move toward one another. The engagement between the head portion 306 and the daughter board 104 and between the coupling member nut 512 and the motherboard 106 as the elongated portion 314 and the coupling member nut 512 move toward one another creates or increases the compressive force 124. The compressive force 124 is applied to the header assembly 102 and the mating connector 108 in the illustrated embodiment to mate the header assembly 102 and the mating connector 108 with one another.

The compressive force 124 may be adjusted by manually manipulating the head portion 306 of the coupling member 122. For example, rotating the head portion 306 increasing amounts in the clockwise direction 606 causes the elongated portion 314 and the coupling member nut 512 to move closer to one another, thereby increasing the compressive force 124. In contrast, rotating the head portion 306 increasing amounts in the counter-clockwise direction (opposite that of the clockwise direction 606) causes the elongated portion 314 and the coupling member nut 512 to move farther from one another, thereby decreasing the compressive force 124.

The compressive force 124 may be manually adjusted to secure the daughter board 104, motherboard 106, mezzanine and mating connectors 102, 108 with one another. The compressive force 124 may be manually adjusted such that the compressive force 124 is large enough to ensure a sufficient mechanical connection between the daughter board 104, motherboard 106, mezzanine and mating connectors 102, 108. For example, the compressive force 124 may be adjusted to ensure that no separation occurs between any of the daughter board 104, the header assembly 102, the mating connector 108, and the motherboard 106.

In one embodiment, rotating the head portion 306 in the counter-clockwise direction causes the elongated body 314 of the coupling member 122 to back out of the coupling member nut 512. For example, the elongated body 314 may move away from the coupling member nut 512 toward the daughter board 104 when the head portion 306 is rotated in the counter-clockwise direction. The elongated body 314 may continue to back out of the coupling member nut 512 until the shoulder 326 in the elongated body 314 engages the finger ends 328 of the fingers 318 in the header assembly 102. Additional rotation of the head portion 306 causes the elongated body 314 to continue to back out of the coupling member nut 512. The engagement between the finger ends 328 and the shoulder 326 in the elongated body 314 prevent the elongated body 314 to be removed through the opening 302 in the header assembly 102. The engagement between the finger ends 328 and the shoulder 326 cause the coupling member 122 to apply a separation force 608 to the mezzanine and mating connectors 102, 108. For example, the counter-clockwise rotation of the elongated body 314 causes the elongated body 314 to continue to move away from the coupling member nut 512. As the elongated body 314 moves away from the coupling member nut 512, the shoulder 326 engages the finger ends 328 to apply the separation force 608 in a direction opposite that of the compressive force 124. The separation force 608 may be used to separate the mezzanine and mating connectors 102, 108 without flexing or bending the daughter board 104 and/or the motherboard 106.

One or more embodiments described herein provides a connector assembly that permits the manual control of compressive and/or tensile forces to mate and separate a header assembly and a mating connector. The compressive and tensile forces may be manually controlled while being applied to the header assembly and the mating connector. The compressive and tensile forces may be more easily controlled to sufficiently mechanically and electrically couple and uncouple the header assembly and the mating connector without damaging the substrates that are electrically coupled by the header assembly and the mating connector.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters, of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 §112, sixth paragraph, unless and until such claim limitations expressly use the phrase "means for" followed by a statement of function void of further structure.

What is claimed is:

1. A connector assembly comprising:

a housing having a mating interface and a mounting interface on opposing sides of the housing, the mounting interface configured to engage a first substrate when the housing is mounted to the first substrate, the mating interface configured to mate with a mating connector mounted to a second substrate, the housing configured to mate with the mating connector to interconnect the substrates in a parallel arrangement;

a contact extending between and protruding from the mating and mounting interfaces of the housing and configured to provide an electrical connection between the substrates; and a compressive coupling member configured to extend through the substrates and the housing in a direction transverse to at least one of the mating and mounting interfaces, the coupling member configured to apply a compressive force to the housing to secure the housing with the mating connector to electrically and mechanically interconnect the substrates, wherein the coupling member comprises a flange for engaging the first substrate and a second flange for engaging the second substrate, the coupling member being manually rotatable to move the opposing flanges toward one another to increase the compressive force and away from one another to decrease the compressive force.

2. The connector assembly of claim 1, wherein the housing comprises a gap between the mating and mounting interfaces to permit air to flow through the housing between the mating and mounting interfaces.

3. The connector assembly of claim 1, wherein the coupling member is disposed approximately perpendicular to the mating and mounting interfaces.

4. The connector assembly of claim 1, wherein the coupling member is configured to apply the compressive force in a direction transverse to the mating and mounting interfaces.

5. The connector assembly of claim 1, wherein the mating and mounting interfaces comprise openings aligned with one another in a direction transverse to the mating and mounting interfaces, the coupling member disposed through the openings.

6. The connector assembly of claim 1, wherein the coupling member comprises an elongated portion and a nut member each having threaded surfaces, the elongated portion engaging one of the substrates and the nut member engaging the other one of the substrates to apply the compressive force.

7. The connector assembly of claim 1, wherein the coupling member comprises an elongated portion and a nut member each having threaded surfaces, the threaded surface of the elongated portion engaging the threaded surface of the nut member such that rotation of the elongated portion adjusts the compressive force.

8. The connector assembly of claim 1, wherein the housing comprises channels extending transverse to the mating and mounting interfaces, the channels configured to receive alignment posts extending transverse to the substrates to align the housing with respect to the substrates.

9. The connector assembly of claim 1, wherein the coupling member is manually operable to adjust the compressive force on the housing.

10. The connector assembly of claim 1, wherein the coupling member is configured to apply a separation force to the housing to separate the housing and mating connector, the coupling member applying the compressive force when the coupling member is rotated in a first direction and applying the separation force when the coupling member is rotated in a second direction.

11. A connector assembly comprising:

a mating connector configured to be mounted to a first substrate;

a header assembly configured to be mounted to a second substrate and to mate with the mating connector to mechanically and electrically interconnect the first and second substrates in a parallel arrangement, the header assembly comprising:

a housing having interfaces on opposing sides of the housing, one of the interfaces for engaging the second substrate and the other of the interfaces for engaging the mating connector to mechanically interconnect the substrates;

a contact extending between and protruding from the interfaces of the housing and configured to engage the mating connector and the second substrate to provide an electrical connection between the substrates; and a compressive coupling member configured to extend through the substrates, the housing and the mating connector in a direction transverse to at least one of the interfaces, the coupling member configured to apply a compressive force to the header assembly and the mating connector to secure the mating connector and the header assembly together.

12. The connector assembly of claim 11, wherein the housing comprises a gap between the interfaces to permit air to flow through the housing between the interfaces.

13. The connector assembly of claim 11, wherein the coupling member is configured to apply the compressive force in a direction transverse to the interfaces of the housing.

14. The connector assembly of claim 11, wherein the interfaces of the housing and the substrates comprise openings aligned with one another in a direction transverse to the interfaces and the substrates, the coupling member configured to be disposed through the openings such that the coupling member extends through the substrates and the interfaces.

15. The connector assembly of claim 11, wherein the coupling member comprises an elongated portion and a nut member each having threaded surfaces, the elongated portion engaging the first substrate and the nut member engaging the second substrate to apply the compressive force.

16. The connector assembly of claim 11, wherein the coupling member comprises an elongated portion and a nut member each having threaded surfaces, the threaded surface of the elongated portion engaging the threaded surface of the nut member such that rotation of the elongated portion adjusts the compressive force.

17. The connector assembly of claim 11, wherein the coupling member comprises a flange for engaging one of the substrates and an opposing flange for engaging the other one of the substrates, the coupling member being manually rotatable to move the opposing flanges toward one another to increase the compressive force and away from one another to decrease the compressive force.

18. The connector assembly of claim 11, wherein the coupling member is configured to apply a separation force to separate the header assembly and the mating connector.

19. The connector assembly of claim 11, wherein the coupling member is manually operable to adjust the compressive force on the substrates.

20. A connector assembly comprising:

a housing having a mating interface and a mounting interface on opposite sides of the housing, the mating and mounting interfaces having openings aligned with one another in a direction transverse to the mating and mounting interfaces, the mounting interface configured to engage a first substrate when the housing is mounted to the first substrate, the mating interface configured to mate with a mating connector mounted to a second substrate, the housing configured to mate with the mating connector to interconnect the substrates in a parallel arrangement;

a contact extending between the mating and mounting interfaces of the housing and configured to provide an electrical connection between the substrates; and a compressive coupling member disposed through the openings in the mating and mounting interfaces, the compressive coupling member configured to extend through the substrates and the housing in a direction transverse to at least one of the mating and mounting interfaces, the coupling member configured to apply a compressive force to the housing to secure the housing with the mating connector to electrically and mechanically interconnect the substrates.

* * * * *